US009897115B2

(12) United States Patent
Meier

(10) Patent No.: US 9,897,115 B2
(45) Date of Patent: Feb. 20, 2018

(54) HYDRAULIC SYSTEM

(71) Applicant: Liebherr-Hydraulikbagger GmbH, Kirchdorf/Iller (DE)

(72) Inventor: Simon Meier, Amendingen (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 785 days.

(21) Appl. No.: 13/689,549

(22) Filed: Nov. 29, 2012

(65) Prior Publication Data

US 2013/0139909 A1 Jun. 6, 2013

(30) Foreign Application Priority Data

Dec. 1, 2011 (DE) ..... 10 2011 119 945

(51) Int. Cl.
*F15B 18/00* (2006.01)
*F15B 13/07* (2006.01)

(52) U.S. Cl.
CPC ..... *F15B 18/00* (2013.01); *F15B 13/07* (2013.01); *F15B 2211/20576* (2013.01); *F15B 2211/3059* (2013.01); *F15B 2211/329* (2013.01); *F15B 2211/783* (2013.01); *Y10T 137/7762* (2015.04)

(58) Field of Classification Search
CPC .. F15B 11/17; F15B 13/0424; F15B 13/0426; F15B 18/00; F15B 13/07; F15B 2211/783; F15B 2211/20576; F15B 2211/329; F15B 2211/20546; F15B 2211/20553
USPC ..... 91/6
See application file for complete search history.

(56) References Cited

U.S. PATENT DOCUMENTS 2,917,282 A * 12/1959 Lee ..... 248/654
2,931,388 A * 4/1960 Renick ..... F15B 21/08 91/363 R
3,613,730 A * 10/1971 Breeden ..... F15B 13/0402 137/625.6
3,729,026 A * 4/1973 Wilke ..... 137/625.69
3,922,855 A * 12/1975 Bridwell ..... B62D 11/183 414/694
4,030,623 A * 6/1977 Bridwell et al. ..... 414/694
5,063,739 A * 11/1991 Bianchetta et al. ..... 60/421
5,333,449 A * 8/1994 Takahashi et al. ..... 60/427
5,381,823 A * 1/1995 DiBartolo ..... 137/494
5,680,762 A * 10/1997 Reid ..... 60/468
6,241,482 B1 * 6/2001 Iga ..... E02F 9/2235 417/212
6,389,809 B1 * 5/2002 Niidome ..... F04B 49/002 60/443
6,609,538 B2 * 8/2003 Royle ..... B60T 8/3665 137/625.65

(Continued)

OTHER PUBLICATIONS

NPL—Collins Dictionary: Transmitter. http://www.collinsdictionary.com/dictionary/english/transmitter. Accessed Jan. 22, 2016.*

*Primary Examiner* — Thomas E Lazo
*Assistant Examiner* — Michael Quandt
(74) *Attorney, Agent, or Firm* — McCoy Russell LLP

(57) ABSTRACT

The present disclosure relates to a hydraulic system with at least two main control valves and with a hydraulic pilot control system for actuating the main control valves, wherein the hydraulic pilot control system and/or the main control valves are constructed such that the at least two main control valves open one after the other.

14 Claims, 5 Drawing Sheets

(56) References Cited

U.S. PATENT DOCUMENTS

| | | | | |
|---|---|---|---|---|
| 8,230,771 | B2 * | 7/2012 | Bitter | A01D 41/145 60/477 |
| 2006/0104786 | A1 * | 5/2006 | Shepherd | E02F 3/436 414/699 |
| 2006/0218914 | A1 * | 10/2006 | Kauss | 60/468 |
| 2007/0130936 | A1 * | 6/2007 | Ikeda et al. | 60/484 |
| 2010/0293936 | A1 * | 11/2010 | Son | 60/420 |
| 2011/0192155 | A1 * | 8/2011 | Hagiwara et al. | 60/421 |

* cited by examiner

HYDRAULIC SYSTEM

CROSS REFERENCE TO RELATED APPLICATION

This application claims priority to German Patent Application No. 10 2011 119 945.8, entitled "Hydraulic System," filed Dec. 1, 2011, which is hereby incorporated by reference in its entirety for all purposes.

TECHNICAL FIELD

The present disclosure relates to a hydraulic system with at least two main control valves and with a hydraulic pilot control system for actuating the main control valves.

When multi-circuit hydraulic systems are supplied with high pressure by a common hydraulic supply, or if more than one hydraulic pumps are supplying hydraulic fluid to a commonload, a complex adjustment of the main control valves to the power control of the pressure supply is required. For this purpose, expensive electronic control systems therefore are used in the prior art.

It is the object of the present disclosure to provide a simpler and more reliable system.

BACKGROUND AND SUMMARY

In accordance with the present disclosure, this object is solved by a hydraulic system comprising at least two main control valves and a hydraulic pilot control system for actuating the main control systems. According to the present disclosure it is provided that the hydraulic pilot control system and/or the main control valves are constructed such that the at least two main control valves open one after the other. In accordance with the present disclosure it can thus be achieved via the hydraulic or mechanical configuration of the hydraulic system that the main control valves are opened in a certain sequence and thus a cascade connection is realized. In particular, the system can be constructed such that the at least two main control valves open at different control pressures of a common control transmitter. This also allows to realize a cascade connection in a hydraulically piloted multi-circuit system, in which the main control valves open in a certain sequence.

In a first variant, the cascade connection can be realized via mechanically and/or hydraulically differently designed main control valves.

In particular, the at least two main control valves can be equipped with springs of different spring force, so that the main control valves open at different control pressures due to the different spring force. The spring of a first main control valve for example can open in a first control pressure range, whereas the spring of a second main control valve opens in a second control pressure range. Otherwise, the main control valves can be constructed identically.

Alternatively or in addition, the at least two main control valves can include different valve rods and/or valve housings, which lead to an opening of the at least two main control valves at different strokes. In this variant, the opening starts of the main control valves are mechanically fixed differently on the valve rods and the valve housings, respectively. This can be effected for example in the form of grooves or holes on the valve rods.

As a result, a cascade connection can be established by valve hardware without corresponding switching logic. The valves thus open at different strokes and hence at different control pressures.

Furthermore, it can be provided according to the present disclosure that at least one of the main control valves is charged with a counterpressure which counteracts the control pressure. The same effect thereby can be achieved as by an increased spring strength, since the counterpressure adds up to the spring pressure and first must be overcome by the control pressure, in order to lead to an opening of the main control valve. In particular, the counterpressure can be constant. Advantageously, a corresponding pressure source therefore is provided.

Furthermore, the cascade connection also can be implemented by a corresponding design of the pilot control unit. For example, there can also be used identical main control valves.

In particular, it can be provided that at least one of the main control valves is actuated via a pressure reducing valve whose output pressure is actuated via the control pressure for another main control valve. Via the pressure reducing valve, another control pressure thereby can be generated for the one main control valve. In particular, the pressure reducing valve can have a pressure ratio unequal to 1 between control pressure and outlet pressure, so that the outlet pressure for actuating the one main control valve is in a fixed ratio to the control pressure for the other main control valve.

Alternatively or in addition, it can be provided that via a pressure shut-off valve at least one of the main control valves is charged with a counter control pressure which counteracts the control pressure. Advantageously, the pressure shut-off valve is charged with the control pressure, so that the counter control pressure rises with the control pressure up to a shut-off pressure. A later opening start also can be achieved thereby in the main control valve, which is charged with the counter control pressure.

Combinations of the above-described possibilities are of course also conceivable. In particular, a first main control valve can be actuated via a pressure reducing valve, whereas a second main control valve is charged with a counter control pressure via a pressure shut-off valve.

Furthermore, the above-described possibilities can of course also be used in more than two main control valves.

In the variants described first, which employ mechanically and/or hydraulically differently designed main control valves, correspondingly different spring strengths or correspondingly differently machined valve rods or valve housings can be used.

Furthermore, in a cascade connection more than one pressure reducing valve or more than one pressure shut-off valve can be used via the pilot control unit, which then correspondingly operate with different pressure ratios or with different shut-off pressures.

Advantageously, the hydraulic system according to the present disclosure includes a common control transmitter via which the at least two main control valves can be actuated. In particular, this control transmitter can generate a control pressure for actuating the at least two main control valves. Despite the common control transmitter, the design of the main control valves or the pilot control unit according to the present disclosure then provides different opening starts of the main control valves.

In a first embodiment, the hydraulic system according to the present disclosure furthermore includes a common high-pressure supply for supplying the at least two main control valves with hydraulic pressure. Advantageously, the high-pressure supply comprises a variable displacement pump which is actuated by the connected load or loads as required.

The cascading of the opening starts according to the present disclosure allows the use of such pressure supply despite a hydraulic pilot control.

According to the present disclosure, the variable displacement pump advantageously is actuated via a load sensing arrangement. In particular, the variable displacement pump is actuated such that a certain pressure drop is maintained over all main control valves and at the same time a maximum pressure is not exceeded. Advantageously, a downstream summation is effected for actuating the load sensing arrangement.

In a second embodiment, the at least two main control valves of the hydraulic system may be separately supplied with hydraulic pressure by at least two separate high-pressure supplies. Advantageously, the high-pressure supplies each comprise a variable displacement pump.

In such an embodiment, if only small flow rates of hydraulic fluid are required, the cascade control of the present invention will only open one of the two main control valves, such that only one of the at least two hydraulic pump will be used to supply the one or more loads with hydraulic pressure. If more hydraulic power is required, the control will also open the second main control valve, such that also the second hydraulic pump is used to supply pressure.

Also in this case, the variable displacement pumps may advantageously be actuated via a load sensing arrangement.

Of course, the system of the present invention can also be used with more than two main control valves and/or more than two hydraulic pumps and/or more than two loads. In this case, the more than two main control vales preferably open in a pre-defined sequence.

In a first embodiment, the at least two main control valves separately control at least two separate loads.

For example, the at least two main control valves may control separate hydraulic cylinders. For example, the at least two hydraulic cylinders may be used to successively move separate elements, such as telescoping in or telescoping out several telescopic elements of a telescopic arm.

Therein, one or several hydraulic pumps may be used for supplying hydraulic pressure, as described above.

In a second embodiment, the at least two main control valves control a common load. This embodiment can in particularly be used if the desired maximum flow rate for controlling this load cannot be achieved by a single main control valve.

In a preferred embodiment, the two main control valves may be separately supplied with hydraulic fluid by separate hydraulic pumps, as described above. Alternatively, the pressure supply may be provided by a common hydraulic pump.

Beside the hydraulic system, the present disclosure furthermore comprises a pilot control system as it has been described above. In particular, it is a pilot control system which hydraulically realizes the cascade connection according to the present disclosure. In particular, as shown above, a pressure reducing valve and/or a pressure shut-off valve can be used for actuating at least one of the main control valves.

Furthermore, the present disclosure comprises a set of at least two main control valves for a hydraulic system as it has been described above. In particular, the main control valves are mechanically and/or hydraulically designed differently. In particular, the two main control valves include springs with different spring force, and/or mechanically differently machined valve rods or valve housings, which lead to an opening start at different strokes.

Advantageously, the pilot control system or the set of at least two main control valves are designed such as has already been set forth above in detail.

The present disclosure furthermore comprises a hydraulically driven implement with a hydraulic system as it has been described above. In particular, the implement is a mobile implement. Particularly, the present disclosure is employed in construction, earth-moving and/or material-handling machines. In particular, the present disclosure comprises a hydraulic excavator with a hydraulic system according to the present disclosure.

In an embodiment, the implement comprises at least two hydraulic pumps for supplying hydraulic pressure for loads of the implement, wherein the at least two main control valves are separately supplied by the at least to hydraulic pumps.

In an embodiment, the at least two main control valves supply the same load with hydraulic fluid.

The load that is supplied by the at least two main control valves may for example be a slewing gear, a traveling gear and/or a hydraulic cylinder for lifting and/or moving a boom or tool.

In a further embodiment, the at least two main control valves separately supply at least two separate loads.

The at least two loads for example can be a slewing gear, a traveling gear and/or a hydraulic cylinder for lifting and/or moving a boom or tool.

The present disclosure will now be explained in detail with reference to exemplary embodiments and drawings.

It should be understood by one skilled in the art that the figures utilize standardized symbols for hydraulic systems, and thus example embodiments may optionally include the detailed features of components as represented.

DETAILED DESCRIPTION

The exemplary embodiments of the present disclosure relate to hydraulic systems comprising at least two main control valves, in particular a multi-circuit load sensing system with downstream summation, which are hydraulically operated under pilot control. According to the present disclosure, there is provided a cascade connection by which the hydraulic control slides used as main control valves are opened in a certain sequence.

The actuation of the system is effected via a common pilot control transmitter 1, in particular a control system via which a certain control pressure is generated for pilot control. The pilot control transmitter for example can be a joystick. The pilot control transmitter 1 can be charged with a constant pilot pressure via a pilot pressure source 15, as it is shown for example in FIG. 3, and reduces the same to the desired control pressure. The constant pilot pressure for example can amount to 35 bar.

Due to its mechanical or hydraulic construction, the hydraulic system according to the present disclosure now allows a cascading of the opening times despite this common actuation. On the one hand, the cascade connection can be realized via different valve springs of the main control valves or via different slide opening starts of the main control valves. There can also be provided a hydraulic cascade pilot control unit, so that the cascade connection is effected via the pilot control. These three alternatives will now again be explained in detail with reference to the exemplary embodiments shown in FIGS. 1 to 3.

Figure 1:
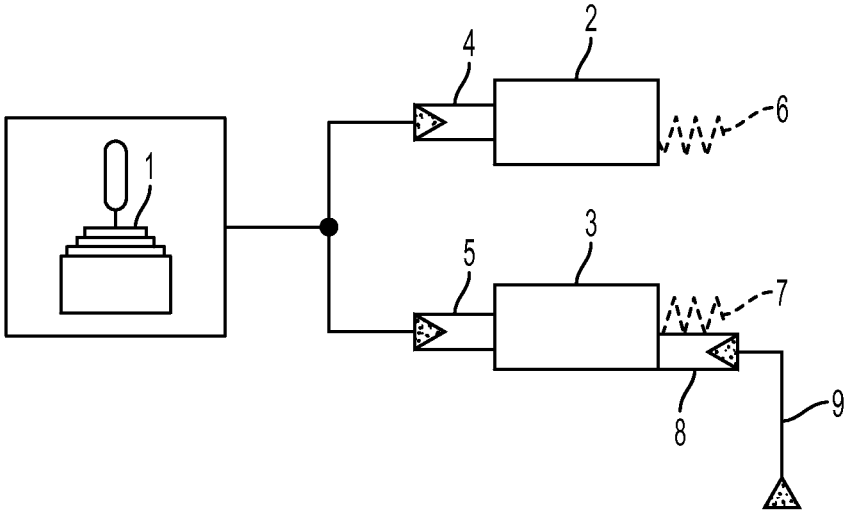
FIG. 1 shows a first exemplary embodiment of a hydraulic system according to the present disclosure with main control valves with different spring strengths.

FIG. 1 shows two main control valves 2 and 3, which each are charged with the same control pressure of the pilot control transmitter 1 at their control pressure ports 4 and 5. According to the present disclosure, the valve springs 6 and 7 of the two main control slides 2 and 3 are chosen such that, e.g., the spring of the slide 2 responds in a first pressure range and the spring of the slide 3 responds in a second pressure range. For example, the spring 6 of the slide 2 can be chosen such that the same responds in a pressure range between 0 and 20 bar, whereas the spring 7 of the slide 3 responds in the range from 20 to 35 bar. Due to the different valve springs, different opening starts thus are achieved.

Alternatively or in addition, in one of the slides (in FIG. 1 the slide 3) a pressure source or corresponding circuit 9 can be provided, which charges the same with a counterpressure. The same effect thereby is achieved as by the mechanical amplification of the spring strength of the slide 3. Via the counter control pressure port 8, the valve 3 is charged with a counter control pressure from the circuit 9, wherein the counterpressure advantageously is constant.

The same spring strength thereby can be used as in the slide 2, which now is amplified via the pressure source 9, since the counterpressure adds up to the spring pressure. For example, the spring strength for the valve 3 likewise can lie between 0 and 20 bar and be amplified by 10 bar from the pressure source 9.

Figure 2:
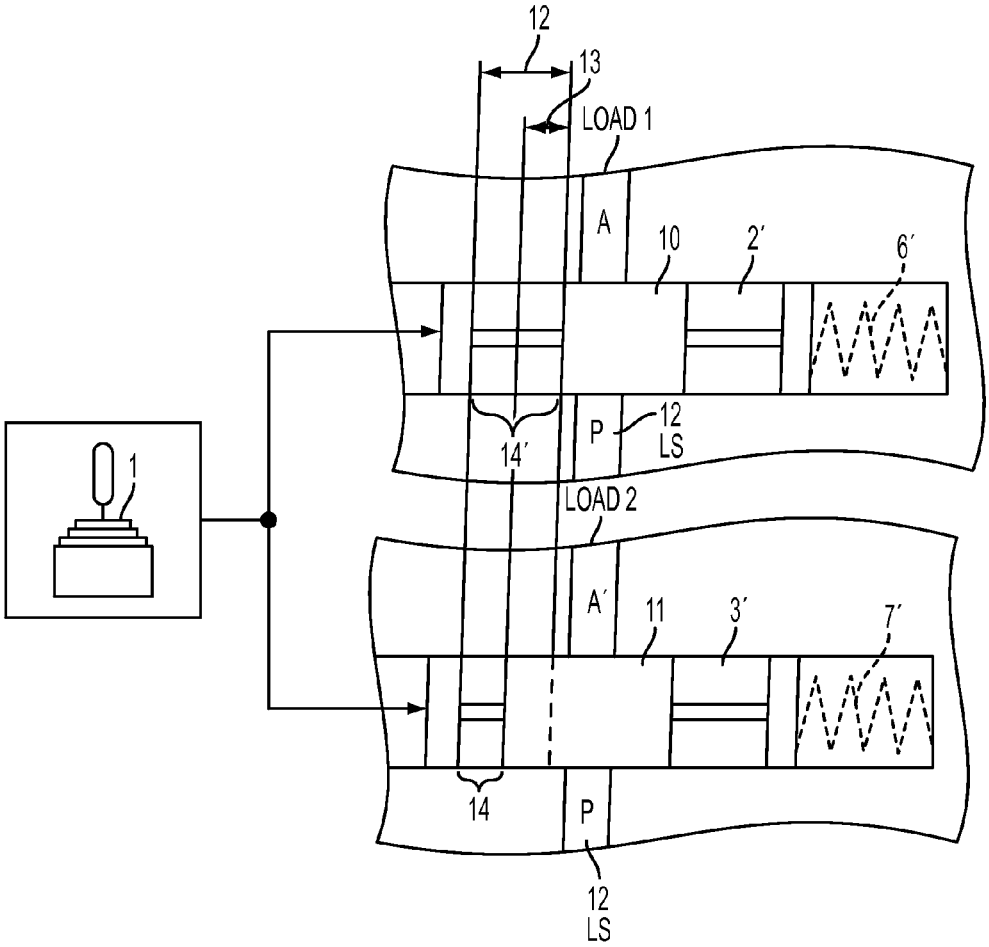
FIG. 2 shows a second exemplary embodiment of a hydraulic system according to the present disclosure with main control valves with differently machined valve rods.

In the variant shown in FIG. 2, the opening starts of the main slides 2' and 3' are, however, mechanically fixed differently on the valve rods 10 and 11. Depending on the manufacturer of the basic slide, this can be effected in the form of grooves or holes. As a result, a cascade connection can be established by slide hardware without corresponding switching logic.

As shown in FIG. 2, both pistons 10 and 11 have the same stroke 12, but the piston of the main control valve 2' already opens after a short distance, whereas the piston of the main control valve 3' only opens later by the stroke 13. In the exemplary embodiment, this is achieved in that the groove 14 on the valve rod 11 of the main control valve 3' is shorter than the groove 14' on the valve rod 10 of the main control valve 2', and thus will only connect the pressure supply P with the opening A or A' leading to the load at a larger stroke. As noted, the pressure supply P may be provided via a common variable displacement pump P' for driving the at least two loads, such as first load (load 1) and second, separate, load (load 2), wherein the variable displacement pump is actuated via a load sensing arrangement LS. The box illustrating load 1 may represent a first gear of a boom, such as a slewing gear or traveling gear, or a hydraulic cylinder of a boom. Likewise, with regard to load 2.

In this exemplary embodiment, the valve springs 6' and 7' also can be designed identically, so that the different opening starts solely are effected by the mechanical design of the valve rods. Alternatively, this might also be effected by a different mechanical design of the valve housings.

Figure 3:
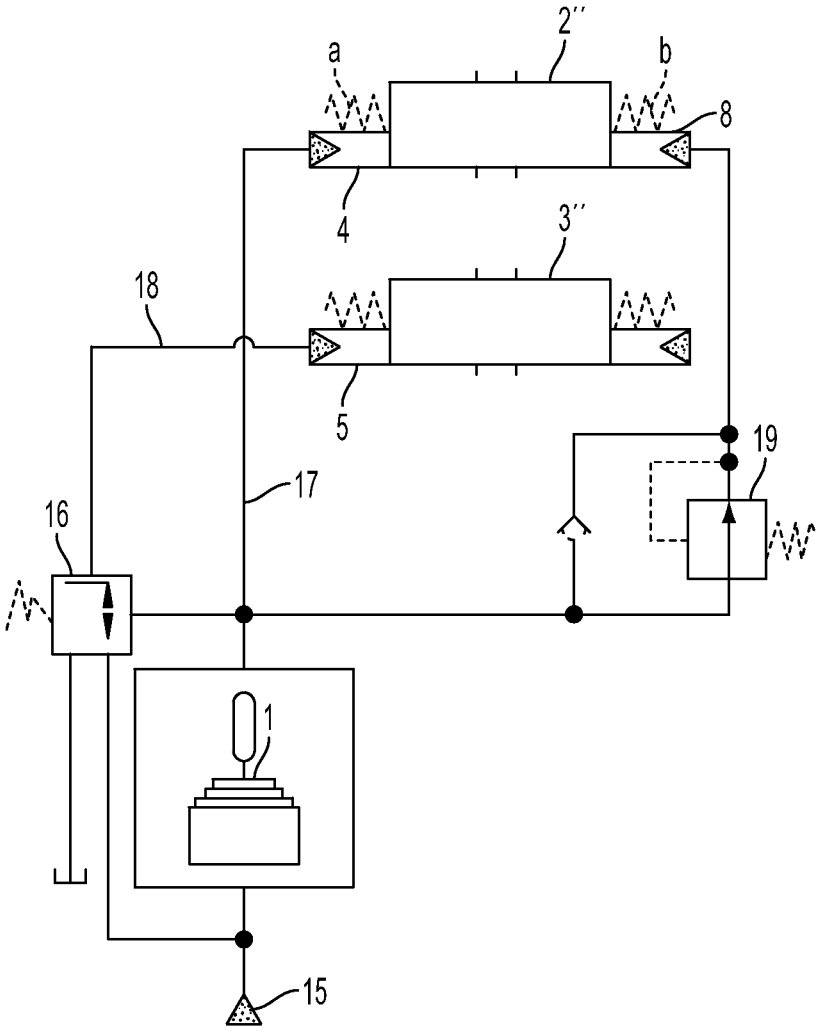
FIG. 3 shows a third exemplary embodiment of a hydraulic system according to the present disclosure with a cascading realized via the pilot control unit.

In the variant shown in FIG. 3, the cascade connection however is realized via a corresponding design of the pilot control valve unit. In particular, the main control slides 2' and 3' thus can be used unchanged. In FIG. 3, two different variants in turn are combined, which can however also be used individually.

On the one hand, a pressure reducing valve 16 can be provided, which is charged with the constant pilot pressure from the pilot pressure source 15. The pressure reducing valve 16 is charged with the control pressure 17 of the pilot control transmitter 1 and has a certain pressure ratio x, so that at the pressure outlet 18 of the pressure reducing valve 16 x times the control pressure 17 is applied. The first main control valve 2' is charged with the actual control pressure 17, the second main control valve 3' with the changed control pressure 18 of the pressure reducing valve. Thus, x times the control pressure specified by the control transmitter acts on the pressure port 5 of the main control valve 3', whereas the simple control pressure specified at the control transmitter 1 acts on the piston pressure port 4 of the main control valve 2'.

Alternatively or in addition, a pressure shut-off valve 19 can be provided, which is charged with the control pressure from the pilot pressure transmitter 1 and has a defined shut-off pressure. Via the pressure from the pressure shut-off valve 19, a counterpressure is exerted on the pressure port 4 of the main control valve 2'. As long as the control pressure lies below the shut-off pressure of the shut-off valve 19, the same pressure acts on both sides a and b of the main control valve 2', so that the same stops in the neutral position. When the control pressure specified at the control transmitter 1 now is increased above the shut-off pressure set at the pressure shut-off valve 19, the pressure at the pressure port 4 will only be increased on the a side, whereas on the b side the pressure set in the shut-off valve 19 remains the same, so that the pressure port 4 now likewise is deflected via the pressure difference between a and b.

As shown in FIG. 3, both variants can also be combined, so that the one valve is charged with counterpressure via the pressure shut-off valve, whereas the other valve is actuated via the pressure reducing valve.

In the case of several valves it would also be conceivable to use several pressure reducing valves with different pressure ratio and/or several pressure shut-off valves with different shut-off pressures.

Furthermore, in the case of two main control valves the pressure for both main control valves also might each be applied via pressure reducing valves with different pressure ratio or via pressure shut-off valves with different shut-off pressure.

Figure 4A:
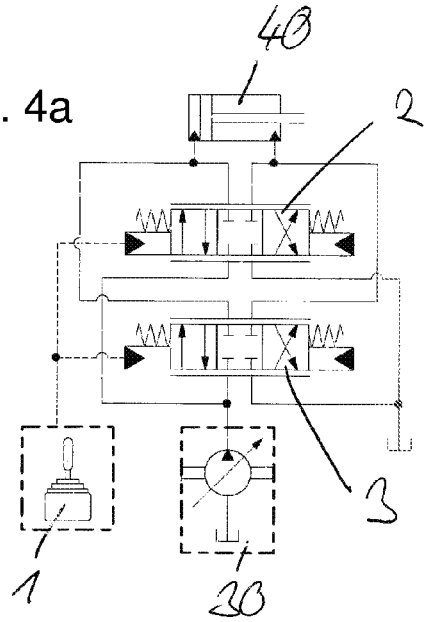
FIGS. 4*a* to 4*d* show four embodiments with different implementations of the cascade control system of the present disclosure with one or more hydraulic pumps and/or one or more loads.
Figure 4B:
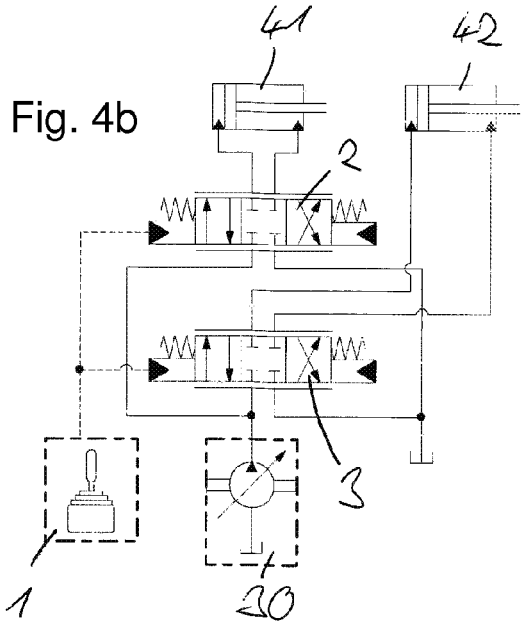
Figure 4C:
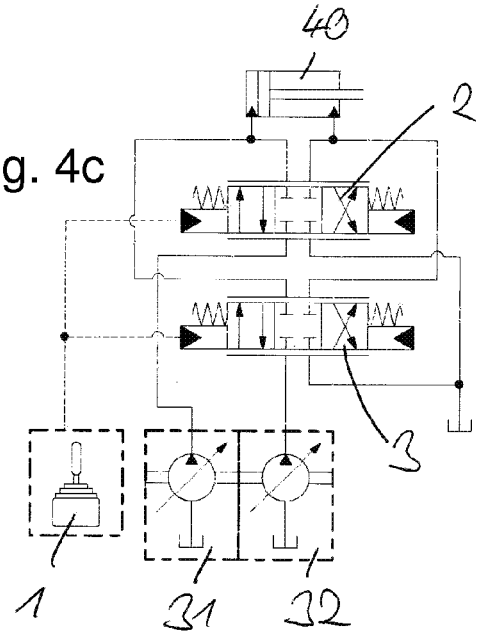
Figure 4D:
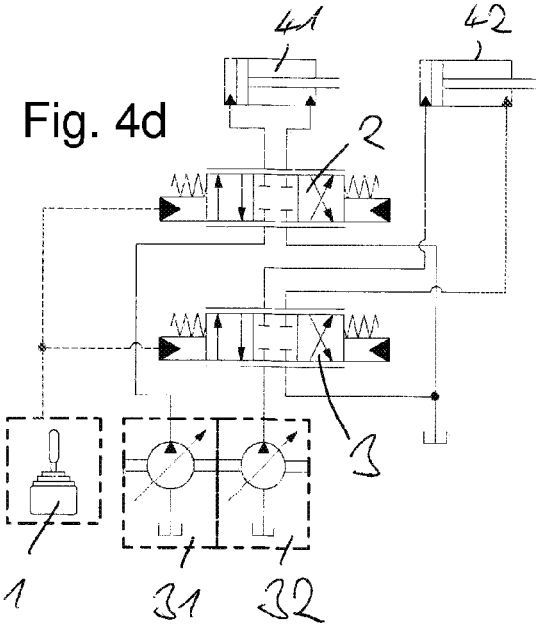
Figure 5:
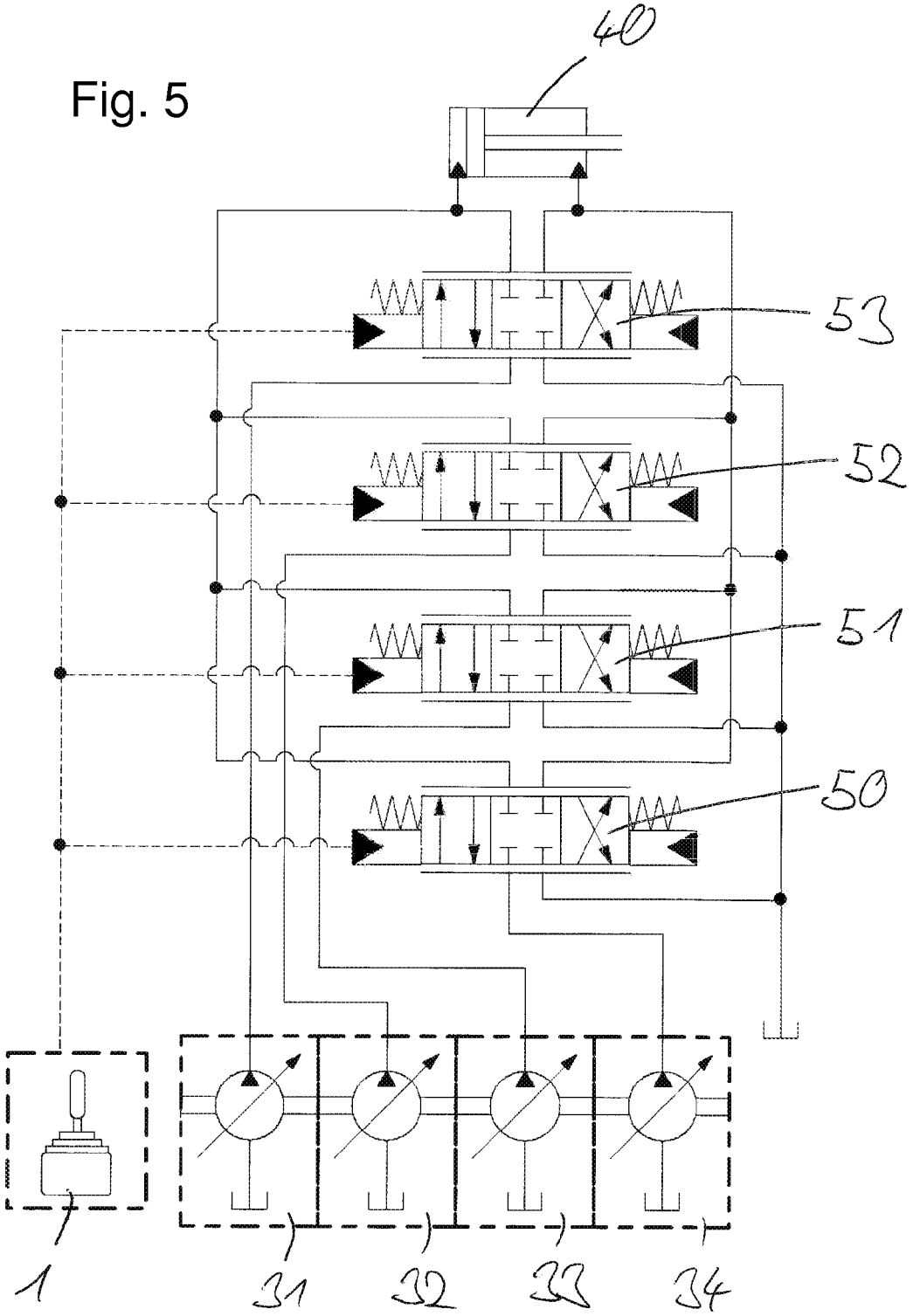
FIG. 5 shows an embodiment of the cascade control system of the present disclosure with more than two main control valves and/or more than two hydraulic pumps.

FIGS. 4*a* to 4*d* show four embodiments showing different implementations of the cascade control system of the present invention with one or more hydraulic pumps and/or one or more loads. In FIG. 4*a*, the two main control valves 2 and 3 are connected entirely in parallel, are supplied by a common hydraulic pump 30 and control the same load 40. In FIG. 4*b*, the two main control valves 2 and 3 are connected in parallel with respect to the pump side and are supplied by a common hydraulic pump 30, but control separate loads 41 and 42. In FIG. 4*c*, the two main control valves 2 and 3 are connected in parallel with respect to the load side and control the same load 40, but are separately supplied by separate hydraulic pumps 31 and 32. In FIG. 4*d*, the two main control valves 2 and 3 are neither connected in parallel with respect to the pump side, nor with respect to the load side. They are separately supplied by separate hydraulic pumps 31 and 32 and control separate loads 41 and 42. FIG. 5 shows an embodiment where more than two main control valves are used. The main control valves 50 to 53 are separately supplied by separate hydraulic pumps 31 to 34, but control the same load 40.

In an embodiment, the hydraulic system is constructed such that the more than two main control valves 50 to 53 open and close in a predefined sequence.

In particular with a high-pressure supply of a multi-circuit system via a load sensing control with downstream summation, the present disclosure allows to hydraulically operate the main control valves under pilot control and nevertheless achieve a cascade connection.

Hydraulic systems according to the present disclosure in particular can be employed in mobile working machines, such as in a hydraulic excavator.

The invention claimed is:

1. A hydraulic system comprising at least first and second main control valves, a pressure reducing valve, and a hydraulic pilot control system for actuating the pressure reducing valve and the first main control valve via a common control pressure, wherein each main control valve includes a spring, and wherein the springs of the main control valves have different spring forces such that the main control valves open in different pressure ranges, and wherein the second main control valve is actuated via an outlet pressure of the pressure reducing valve.

2. The hydraulic system according to claim 1, wherein the first and second main control valves further include different valve rods and/or valve housings to open the first and second main control valves at different strokes.

3. The hydraulic system according to claim 1, wherein at least one of the main control valves is charged with a counterpressure which counteracts the common control pressure.

4. The hydraulic system according to claim 1, wherein at least one of the main control valves is charged with a counter control pressure via a pressure shut-off valve, which counteracts the common control pressure and rises with the common control pressure up to a shut-off pressure.

5. The hydraulic system according to claim 1, wherein the common control pressure is supplied to the first and second main control valves via a common high-pressure supply.

6. The hydraulic system according to claim 1, wherein the common control pressure is supplied via a common variable displacement pump, wherein the variable displacement pump is actuated via a load sensing arrangement.

7. A hydraulically driven implement with the hydraulic system according to claim 1.

8. The hydraulic system of claim 7, wherein the implement is a mobile implement, and wherein the first and second main control valves separately control at least two separate loads.

9. The hydraulic system of claim 7, wherein the implement is a hydraulically driven implement comprising at least two hydraulic pumps for supplying hydraulic pressure for loads of the implement, wherein the at least two main control valves are separately supplied by the first and second hydraulic pumps, and wherein the first and second main control valves supply the same load with hydraulic fluid.

10. The hydraulic system of claim 9, wherein the load that is supplied by the first and second main control valves includes a slewing gear, a traveling gear, or a hydraulic cylinder.

11. The hydraulic system of claim 1, wherein the first and second main control valves control a common load.

12. A hydraulic system comprising:

a first main control valve actuating a first load and having a first spring;

a second main control valve actuating a second load separate from the first load and having a second spring; and a hydraulic pilot control system for actuating the main control valves via a common control pressure, wherein the first and second springs have different spring forces, and wherein the main control valves have different valve rods and/or valve housings, such that the main control valves open at different strokes due to the different valve rods and/or valve housings and at different control pressures due to the different spring forces, only one after the other.

13. The system of claim 12, wherein the first load is a slewing gear or a traveling gear.

14. The system of claim 13, wherein the second load is a hydraulic cylinder.

* * * * *